United States Patent [19]

Grooters

[11] 4,248,516

[45] Feb. 3, 1981

[54] SELF-THREADING PHOTOGRAPHIC PROCESSOR

[75] Inventor: James D. Grooters, Wayzata, Minn.

[73] Assignee: Pako Corporation, Minneapolis, Minn.

[21] Appl. No.: 113,091

[22] Filed: Jan. 17, 1980

[51] Int. Cl.[3] ..... G03D 3/13

[52] U.S. Cl. ..... 354/321; 134/64 P

[58] Field of Search ..... 354/320, 321, 322, 313, 354/314; 134/64 P, 122 P; 226/119, 188, 91

[56] References Cited

U.S. PATENT DOCUMENTS

| | | | |
|---|---|---|---|
| 1,385,403 | 6/1921 | Sentou et al. | 354/321 |
| 1,946,841 | 2/1934 | Ybarrondo | 354/321 |
| 1,967,889 | 7/1934 | Kitroser | 354/321 |
| 2,853,294 | 9/1958 | Woodcock | 354/321 X |
| 3,533,349 | 10/1970 | Schmidt | 354/321 |
| 3,602,125 | 8/1971 | Hersh | 134/64 P |

*Primary Examiner*—L. T. Hix
*Assistant Examiner*—Alan Mathews
*Attorney, Agent, or Firm*—John W. Adams

[57] ABSTRACT

A multiple compartment photographic processor particularly adapted to facilitate threading a web to be processed through a predetermined web processing path traveling successively from one processing compartment to another. The ultimate processing web path is defined by two sets of web engaging rollers, one set constitutes web driving rollers mounted above the perspective compartments and the other set constitutes weighted idler rollers positioned in proximity to the bottom of the respective compartments and supported by flexible tape and pulley support systems designed to counterbalance only a portion of the respective weighted rollers. An initial substantially planar threading web path is provided by elevating the idler rollers above the driving rollers to permit the leading end of the web to be passed between the two sets of rollers directly to a takeup roller. The driving rollers are respectively driven through individual clutch mechanisms which are responsive to the positions of weighted idler rollers within their respective compartments so that the clutches are actuated whenever the idler rollers are in their lower-most positions in the compartments and are deactivated when said idler rollers are raised above their lower-most positions. The clutch for the driving roller delivering the web into the next compartment remains disengaged whenever the idler roller in the next preceeding compartment is above its extreme lower position. The clutch arrangement controlled by the idler roller in the last compartment controls the driving connection to the final takeup roller and the entire web transport system constitutes a self-adjusting tension equalizing drive mechanism for the web through its operative processing web path during the operation of the processor unit.

5 Claims, 2 Drawing Figures

SELF-THREADING PHOTOGRAPHIC PROCESSOR

BACKGROUND OF THE INVENTION

In the past, film processors have included various means for threading a web of photographic material to be processed through a plurality of processing tanks which, for example, may include developer, a stop bath, fixer liquid and wash liquid. In one prior art processor dip or idler rollers have been mounted on elongated rods which pass through overhead guides and are progressively lowered into the respective tanks as the web is initially fed into the tanks during the threading process. Such a device was sold as the Williamson Processor by the Pako Corporation, assignee of the present invention. The Williamson unit proved to be relatively complicated although it has operated successfully for many years. The present invention is greatly simplified and substantially less expensive to manufacture than its predecessor. Instead of the slideable guide rods, each idler or dip roller is connected to one end of a flexible tape which passes over suitable guides and has a counterbalancing weight attached at the other end thereof. As each dip roller is progressively lowered into the tank, the weight on the other end of the tape is raised and when the roller reaches its predetermined operative position in the lower portion of the tank, the weight is elevated into engagement with a clutch engaging mechanism for actuating the next successive feed roller to cause the web to be fed downwardly into the next tank and lower the idler or dip roller therewith into its operative position.

SUMMARY OF THE INVENTION

In the present invention a plurality of liquid confining compartments are illustrated and have a set of web driving or feeding rollers mounted on fixed axes respectively disposed at the top of the compartments. These are controllably driven as will be described. A second set of rollers constitutes idler or dip rollers suspended by means of respective tapes, guiding means and counterweights. As the driving or feeding rollers are successively actuated by an automatic clutch mechanism, the web is progressively fed downwardly into the respective compartments and the idler rollers which are respectively supported on the loop portions of the web are lowered with the respective web loops into the respective compartments. This is a successive operation where the web is initially fed into the first compartment to lower the first idler roller downwardly into its operative position and at that time the next driving or feeding roller is actuated by engagement with the counterweight against a clutch control arm so that a second web path which constitutes an operative path is ultimately defined through all of the compartments for processing the web.

DETAILED DESCRIPTION OF THE PREFERRED EMBODIMENT

Figure 1:
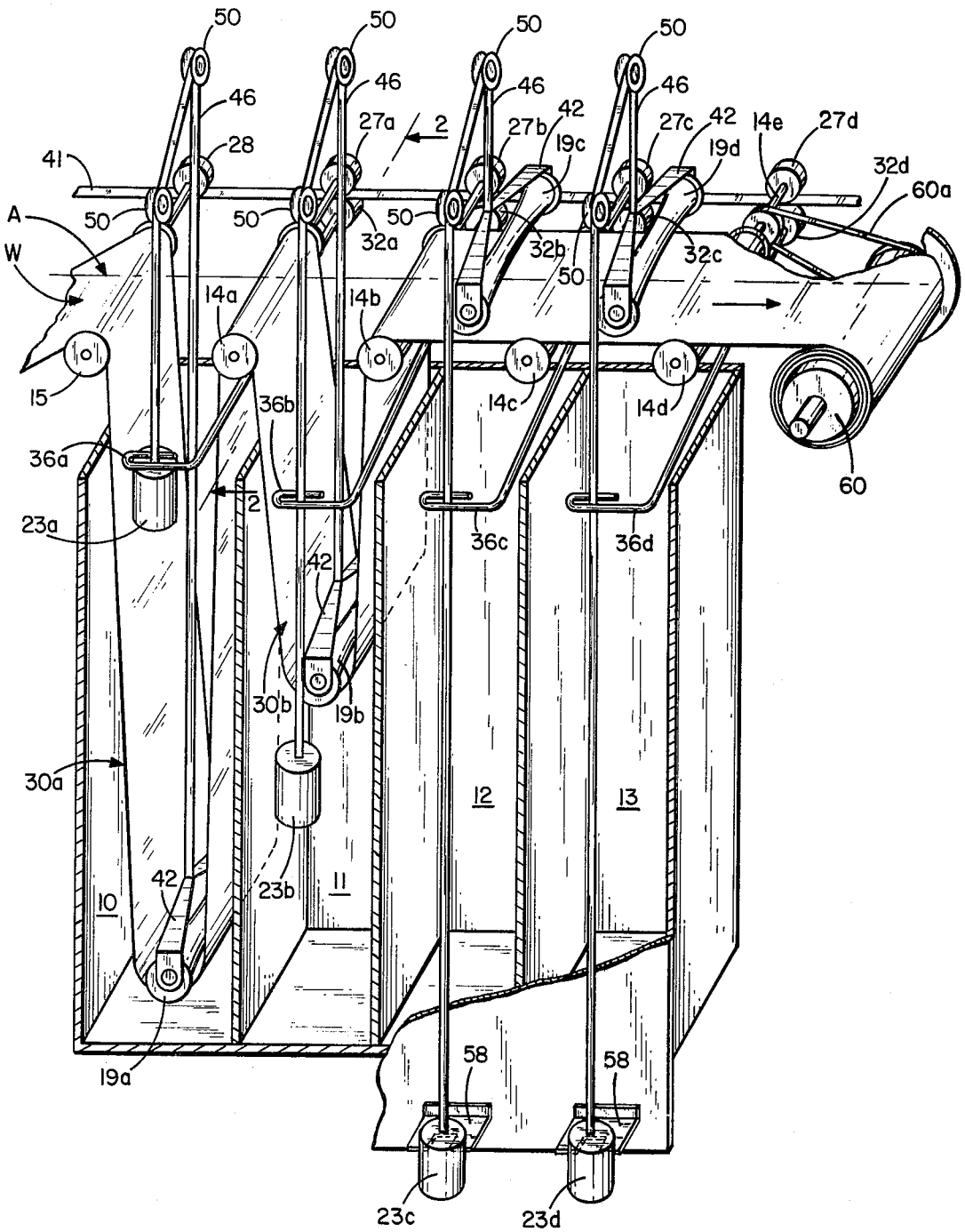
FIG. 1 is a vertical sectional view showing a plurality of processing compartments with the web partially fed into its ultimate operative web path therein.

This invention is a multiple compartment photographic processor which has a web guiding and threading transport system for a web 'W' to be processed. Although FIG. 1 shows four processing tanks or compartments for confining the processing liquids, more compartments may be (and in most instances would be) used without changing the substance of the invention. In the form of the invention illustrated, there is a single developer tank 10, a stop bath tank 11, a fixer tank 12, and a wash tank 13.

A set of web-driving or feeding rollers 14*a*, 14*b*, and 14*c* is mounted above the compartments. A set of dip or idler rollers 19 is initially mounted above the web-driving rollers 14*a*, 14*b*, and 14*c* when the machine is in pre-operative initial threading position to define a substantially planar initial threading web path A between web driving rollers 14*a*, 14*b*, and 14*c* and idler rollers 19. The idler rollers 19 are successively lowered into the compartments during the automatic threading operation of web into an operative processing web path B through the compartments. Each of the idler rollers 19 is supported by a supporting yoke 42 connected to one end of a supporting tape 46 which is trained around a series of guides such as the rollers 50. A counterweight 23 is attached to the opposite end of each supporting tape 46 and is designed to counterbalance only a portion of the weight of the idler roller 19. When the second set of rollers 19 is in elevated initial threading position, each counterweight 23 is anchored by a retaining bracket 58.

Figure 2:
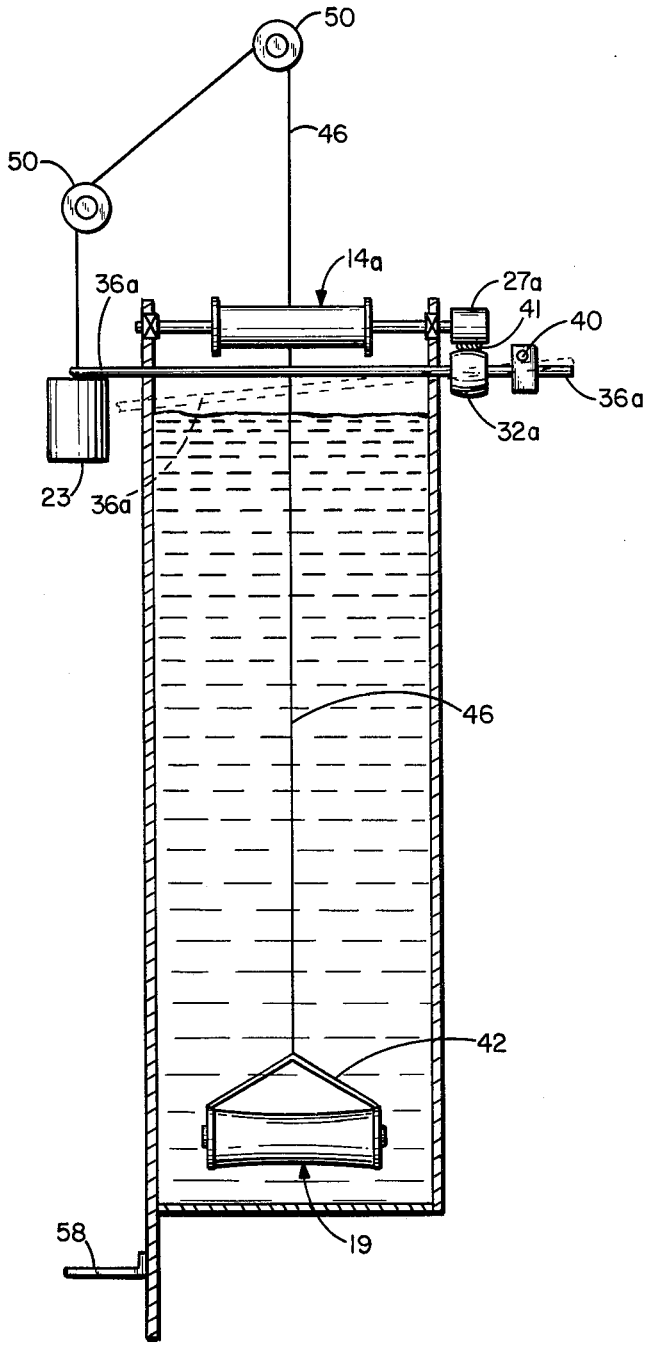
FIG. 2 is a vertical sectional view taken substantially along the line 2—2 of FIG. 1.

A set of roller drive wheels 27 is mounted above the compartments for respectively driving the rollers 14*a*, 14*b*, and 14*c*. A set of clutch pressure wheels 32 is mounted on a set of control arms 36, and the wheels 32 are respectively disposed in opposed relation to a set of the roller drive wheels 27; provided, however, the first roller drive wheel 28 is a pacer roller and is constantly driven by a friction drive belt 41 (whenever the belt is driven) and therefore said pacer roller 28 does not in the form shown, have a clutch pressure wheel 32 for driving the same. A pivot shaft 40 is best shown in FIG. 2 and provides the pivotal mounting for the control arm 36 and the clutch pressure wheels 32 respectively mounted thereon. A friction drive belt 41 is interposed between the set of roller drive wheels 27 and the set of clutch pressure wheels 32 to provide the source of driving power for the set of drive rollers 27. The friction drive belt 41 may be driven by any conventional means, such as an electric motor (not shown).

The leading end of the web is initially drawn from a supply roll (not shown) and threaded between the set of rollers 14 and 19 through the initial substantially planar web path "A" across the tops of the compartments and attached to a take-up spool 60 which is driven by belt 60*a* connected to the drive shaft 14*e* on which idler roller 14*d* is journalled. All of the counterweights 23 are released to drop the idler rollers 19 onto the web portions disposed in web path A. The drive belt 41 is then activated. The drive belt 41 continuously drives the first roller drive wheel or pacer roller 28. The pacer roller 28 feeds the web into the first (developer) compartment 10 to produce first a depending loop or festoon 30*a*. The first idler roller 19*a* follows the first web festoon 30*a* or loop downwardly into the processing liquid in the first compartment. As the idler roller 19*a* moves downward, its counterweight 23*a* moves upward and when the idler roller 19*a* reaches its final predetermined operative position in the lower portion of the compartment 10. the counterweight 23*a* engages the free end of the first control arm 36*a* and raises the same which in turn raises the clutch pressure wheel 32*a* which is rotatably mounted on the control arm 36*a*. This action causes the friction drive belt 41 to establish driving contact with the opposing roller drive wheel 27*a* which in turn drives the web-engaging driving roller 14*a*. Activation of this driving roller 14*a* causes the web in the second compartment 11 to move downwardly with the second idler roller 19*b*, thus causing the counterweight 23*b* to rise as previously described for the first compartment 10. This process is repeated successively for each compartment until the entire machine is threaded and the entire set of the loops 30 are fully formed to provide the operational web path B through all the compartments 10, 11, 12, and 13.

The drive rollers 14*a*, 14*b* and 14*c* are all slightly larger in diameter than the pacer roll 15 to produce a pulling tension on the web as it travels through its processing web path.

It should be pointed out the positions of the weighted idler rollers during the processing of the web fluctuate up and down as the tension in the web varies during its travel through the processing compartments. Whenever the weighted idler rollers move up in response to increased tension in the web, the weight controlling the actuating arm for the next driving roller must be lowered to reduce the effective frictional driving connection between the roller drive wheel for that driving roller and the friction drive belt 41 which reduces the driving speed imparted to the web for the upward roll of the web in that compartment. This produces a lengthening of that loop and causes the idler roller to move downwardly to re-establish maximum frictional drive with the drive belt 41 so that this drive mechanism constitutes a self-adjusting tension equalizing drive mechanism for the web through the processor. This same equalizing effect is produced on the drive for a final takeup roll 60 so that as the diameter of the coil of processed web material increases, the driving speed imparted to the takeup roll 60 will automatically compensate due to the equalizing effect of the drive mechanism described above.

This same drive mechanism may also be used in film drying processes, in which case there would be no liquid in the processing compartments.

What is claimed is:

1. A machine for processing an elongated web of photographic material, having an automatic self-threading roller transport system, said machine comprising:

a plurality of processing compartments suitable for confining processing liquid therein, including at least a first and second compartment, a set of web-engaging driving rollers respectively mounted above said compartments to respectively feed the web into the compartments, a set of weighted idler rollers mounted for movement into and out of each compartment and respectively lowered into the compartments when a web of material is being processed, releasable means for initially holdng said set of weighted idler rollers in raised position, said two sets of rollers defining two principal web paths, one constituting a substantially planar initial threading path located above said compartments with the weighted rollers held in elevated position thereabove to permit the leading end of the web to be initially threaded through said path above said compartments, the other web path constituting the operative web path defined by said two sets of rollers when said weighted rollers have been lowered into their operative positions in the respective compartments after the automatic threading operation, means connected to said weighted idler rollers for counterbalancing only a portion of the weight thereof, controllable means for driving the web engaging driving rollers, control means controlling the actuation of said driving means for the second compartment actuated by the first weighted roller being lowered into operative position within the first compartment to actuate the second drive roller to feed the web into said second compartment and, control means for successively actuating the drive rollers for each of the other compartments responsive to the lowering of the next proceeding weighted roller into its operative position and thus ultimately produce a second web path through the compartments which constitutes said operative web path.

2. The structure set forth in claim 1 wherein the means connected to each idler roller for counterbalancing a portion of the weight thereof constitute a weight, an elongated tape connected at one end of the weight and at the other end to the roller, and a pulley system for suspending a roller and permitting the roller to descend into its compartment when the web is being fed into said compartment by the drive roller.

3. The structure set forth in claim 2 and releasable retaining means for holding each weight in lower position to retain the idler roller in its elevated position during the initial threading operation.

4. The structure set forth in claim 1 and a continuously driven pacer roller having driving engagement with the web for continuously feeding the web into the first processing compartment after the web has been initially threaded through said initial threading path.

5. The structure set forth in claim 1 and said control means including:

a set of roller drive wheels respectively connected to said drive rollers for driving the same, a set of pivoted control arms underlying each web drive roller, a set of clutch pressure wheels respectively mounted on said arms in opposed normally spaced apart relation below, said counterbalancing means permitting the idler rollers to move successively downwardly into the respective compartments as the web of material is fed into the machine, a friction belt interposed between the two sets of wheels, means responsive to the lowering of the idler rollers into operative position to produce engagement between the friction belt and the roller drive wheels, means for driving said belt.

* * * * *